United States Patent [19]

Gerber et al.

[11] 4,060,419

[45] Nov. 29, 1977

[54] METHOD OF FORMING SILVER HALIDE GRAINS BY ELECTROLYSIS

[75] Inventors: Arthur M. Gerber, Boston; Vivian K. Walworth, Concord, both of Mass.

[73] Assignee: Polaroid Corporation, Cambridge, Mass.

[21] Appl. No.: 672,647

[22] Filed: Apr. 1, 1976

[51] Int. Cl.[2] ..... G03C 1/02; C25B 1/24

[52] U.S. Cl. ..... 96/94 R; 96/94 BF; 204/94

[58] Field of Search ..... 96/94, 94 R, 94 BF; 204/56 R, 94, 180 P

[56] References Cited

U.S. PATENT DOCUMENTS

| | | | |
|---|---|---|---|
| 466,720 | 1/1892 | Currie | 204/94 R |
| 1,602,595 | 10/1926 | Sheppard et al. | 204/94 |
| 1,801,784 | 4/1931 | Schwarz | 204/180 P |
| 2,827,428 | 3/1958 | Noble | 96/94 |

FOREIGN PATENT DOCUMENTS

| | | | |
|---|---|---|---|
| 1,079,452 | 4/1960 | Germany | 204/94 |
| 643,223 | 9/1950 | United Kingdom | 204/94 |

*Primary Examiner*—Mary F. Kelley
*Attorney, Agent, or Firm*—Philip G. Kiely

[57] ABSTRACT

Photosensitive silver halide emulsions are prepared by the precipitation of silver halide grains from silver and halide ions generated by electrolysis.

34 Claims, 4 Drawing Figures

METHOD OF FORMING SILVER HALIDE GRAINS BY ELECTROLYSIS

BACKGROUND OF THE INVENTION

Photographic silver halide emulsions are generally prepared by precipitation of the silver halide in the presence of a carrier or binder, generally gelatin, wherein the silver halide grains are formed by the interaction of a water-soluble silver salt, such as silver nitrate, and a water-soluble halide, such as potassium bromide. The formation of the silver halide grain is usually accompanied by the liberation of counterions which must be removed in order to render the surface of the silver halide grain available for efficient chemical sensitization and to coat the grains without the risk of formation of crystals of the counterions which would deform the emulsion layer and render it unsuitable for photographic use.

In order to avoid the deleterious effects of the counterions, extensive removal techniques well known to the art are employed. These washing operations are varied and extensive and occupy a large proportion of the time and equipment employed in emulsion manufacture. The removal of the counterions by a washing procedure is one of the most critical phases of emulsion manufacture since the quality or even the usefulness of the emulsion depends upon this procedure. The term "grain" as used herein refers to a crystalline particle of silver halide and should be understood to include particles of any composition of silver halide with any mixture of crystal habits.

From the foregoing, it will be noted that the formation of the silver halide grains and the sensitization takes place in the presence of a binder material. Gelatin is the most commonly used binder material for silver halide, but other materials such as synthetic polymers are also employed. It is a requirement of the binder material that it permit the growth of silver halide grains at a controllable rate. The binder material must also be capable of being noodled or flocculated to permit washing of the emulsions to remove unwanted counterions and excess salts. It is also a requirement that the binder material allow the various sensitization processes to take place. A further requirement is that the binder prevent agglomeration of the silver halide grains and not be salted out by the counter ions present. These requirements disqualify a large number of synthetic polymeric materials from being employed in silver halide emulsions when otherwise they may possess some properties desired in such employment. For example, some polymers are good for grain growing but not for the washing step, and vice versa. In addition, because the reaction forming the silver halide grains takes place in the presence of the binder, starting materials and reaction products other than silver halide are entrapped therein, which contribute to the necessity of the above-mentioned extensive washing procedures.

A novel method for forming emulsions has now been found which is not susceptible to the deficiencies of the prior art and which circumvents the above limitations by forming silver halide grains without substantially increasing the concentration of counter-ions and therefore eliminates wash steps and removes many restrictions on polymers.

SUMMARY OF THE INVENTION

The present invention is directed to a method for preparing photographic silver salt emulsions which comprises the steps of electrolytically generating silver ions and soluble negative ions, preferably halide, in a solution of an electrolyte, reacting the silver ions and negative ions remote from the electrode, to form grains, growing the grains to the desired size, disposing the grains in a polymeric binder such as gelatin, and coating the binder-grain mix. Conventional sensitization and addenda may be employed as desired.

The novel method of the present invention obviates the critical and tedious washing requirements of the prior art. In a preferred embodiment, the electrolytic generation of the ions is carried out in the presence of a polymeric binder material; however, the binder is not critical and the reaction can be carried out without any binder in the electrolyte solution.

The term "electrolyte" as used herein is intended to refer to a substance that dissociates into two or more ions, to some extent, in water and thus provides a solution which conducts electric current. The term is also intended to include one or a combination of electrolytes.

The term "remote from the electrodes" as used herein is intended to refer to the reaction of the ions in the electrolyte solution spatially removed from the electrode, i.e., the silver salt is not plated on either of the electrodes.

DETAILED DESCRIPTION OF THE INVENTION

Figure 1:
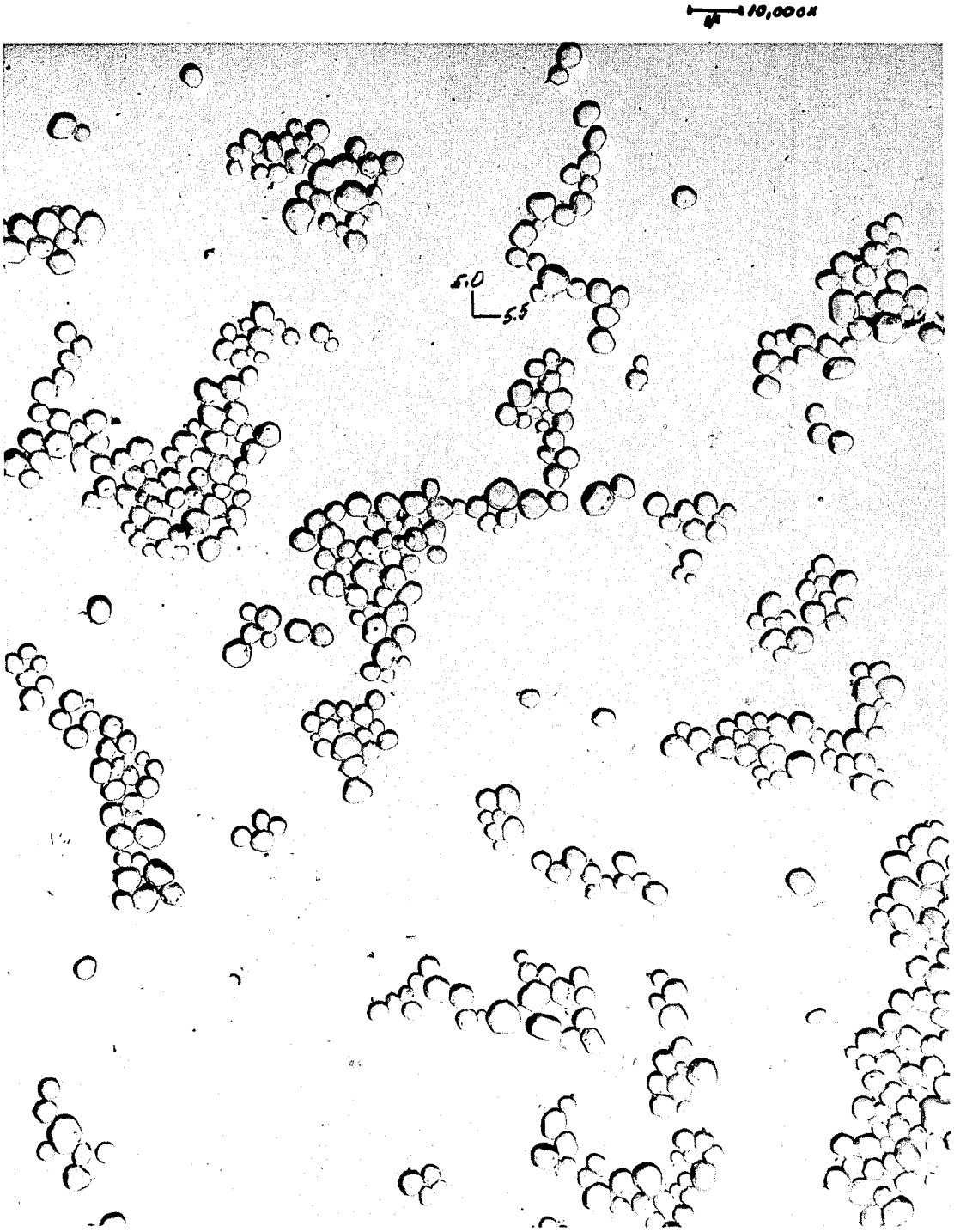
FIG. 1 is a photomicrograph at 10,000magnification of silver iodobromide grains prepared according to the procedure of Example I.

The present invention avoids the use of the conventional sources for the silver and negative ions employed in the formation of silver salt grains, e.g., in the case of silver halide, the silver nitrate and potassium halide salts. By utilizing the essential ionic reactants only, normally associated counter-ions, such as $NO_3^-$ and $K^+$, are not involved in the reaction and, therefore, need not be removed or otherwise taken into account in the process. Because the silver and halide ions are produced substantially stoichiometrically, an unwanted excess of either ion is avoided, thus eliminating a problem encountered in conventional precipitation of silver halides with respect to the control of excess halide concentration which influences the rate of growth, grain size and grain habit.

The term "substantially stoichiometric" is intended to refer to a sufficient equivalence of silver ions and halide ions to form silver halide grais so that there is not such as excess of either silver ions or halide ions at the end of the electrolysis as to be photographically undesirable.

The present invention contemplates the precipitation of silver salts from only the essential reactants, $Ag^+$ and $X^-$, wherein $X^-$ is a soluble anion, e.g., halide, which are provided by the reaction of the respective electrodes comprising a relatively simple electrolytic cell, one electrode (anode) being silver, the other (cathode) being a source of a negative ion which will form an insoluble salt with the silver. For convenience, the process of the present invention will be described in terms of the formation of silver halide grains; however, it will be understood that any negative ion may be employed in the electrolysis which will provide an insoluble, photographically active silver salt grain. For example, the cell and the reactions may be represented as follows:

The cell:

$$Ag/Ag^{+}// Br^{-}/ AgBr \text{ (solid)} / Ag$$

Anode reaction:

$$Ag^{\circ} \rightarrow Ag^{+} + e$$

Cathode reaction:

$$AgBr + e \rightarrow Ag^{\circ} + Br^{-}$$

The silver and halide ions produced at the two respective electrodes diffuse into the electrolyte where they react to form a precipitate of silver halide:

$$Ag^{+} + Br^{-} \rightarrow AgBr \downarrow$$

In a preferred embodiment, a relatively small amount of polymeric binder may be employed, e.g., about 1% gelatin in the electrolyte. It should be noted that the selection of a binder is not limited to the types ordinarily characterized as optimum for growing grains since the binder, in the prior art, is principally present to prevent agglomeration of grains as they form. Selection of a binder material need not be limited to those which can be flocculated or gelled and noodled, as in conventional emulsions, since these properties are associated with washing requirements which do not exist in the present invention.

Subsequent to or concomitant with, the formation of the grains a ripening step may be employed to grow the particles to the desired size. Since no counter-ions are present, a wash step is not required. The particles may be separated from the electrolyte, as by filtering or centrifuging before a ripening step. Alternatively, ripening and other processing operations may be carried out in the same medium without separation of the grains from the electrolyte. Ostwald ripening agents may be employed to grow grains to the desired size. Silver halide growing agents known to the art which may be employed include ammonia, thiocyanate, thioethers and excess halide.

Alternatively, electrolysis may be continued after initial grain formation to provide grain growth under conditions of temperature and current density which do not preview new nucleation.

Subsequent to grain growth, binder polymer may be added, as well as chemical and/or spectral sensitizers, coating aids, dispersing agents or other emulsion addenda conventionally employed in the art.

Any suitable electrolyte which is not detrimental to the photographic process and which does not require a removal step may be employed. Electrolytes may also be selected for other utility in addtion to electrical conductance. Such electrolytes may also function as pH buffers, pAg buffers, redox buffers, developing agents, Ostwald ripening agents, quaternary salts, dispersants and surfactants. Chemical and spectral sensitizing agents may also be present in the electrolyte during electrolysis to provide sensitization of the grains as they are formed.

It has also been found that a conductive polymer can be employed as the electrolyte. Thus providing both the conductivity required and at least a portion of the binder material. A particularly useful conductive polymer comprises poly-2-acrylamido-2-methylpropane sulfonic acid.

In a preferred embodiment, a pAg buffer is employed. A particularly useful pAg buffer/electrolyte is the disodium salt of ethylene diamine tetraacetic acid (EDTA). Other suitable pAg buffers include combinations of EDTA salts with the free acid and gluconic acid, alone or with EDTA.

In the novel process of the present invention pAg may be controlled. pAg may be set initially by addition of dilute KBr or $AgNO_3$ and maintained as there is no dilution in the course of the reaction and the reactant ions are generally generated in stoichiometric balance. Since pAg may be controlled and maintained consistently low throughout the precipitation, the present invention is particularly suited for the preparation of homogeneous emulsions with preferred and predetermined crystal habit and uniform grain size distribution. Alternatively, the pAg may be programmed by setting conditions, such as cell voltage, so that ions are generated in a nonstoichiometric ratio.

Any electrode that can generate a desired negative ion by electrolytic action can be employed as a cathode in the present invention. The cathode may comprise an insoluble halide salt, preferably silver halide. Other suitable cathode materials may comprise, for example, thallium halide, gold ($Au^{+1}$) halide, lead halide or elemental bromine.

A cathode comprising silver halide may be generated by a preliminary electrolysis in a cell by methods known to the art.

A single pair of electrodes may be employed or a plurality of electrodes of various combinations. Alternatively, the electrode may be composed of an insoluble salt or a mixture of salts. In still another embodiment, the ion source may comprise a halogen absorbed onto an inert carrier contained in a porous container, such as bromine on starch granules contained in a porous aluminum oxide thimble which allows ions to flow but retains the particles therein. Still another embodiment employs bromine in a conductive polymer. In still a further embodiment, solid silver halide may be disposed in a conductive, permeable binder to provide the electrode.

The desired distribution of halide may be achieved by employing chloride, iodide and bromide electrodes in any ratio, sequentially or concomitantly. Alternatively, a silver halide electrode may be prepared with one halide and then converted at least in part to a second halide. Thus, an AgBr electrode can be prepared and then converted to AgBrI or AgI by providing $I^{-}$ to the electrolyte.

It will be readily seen that the process of the present invention is economical, versatile, adapted to continuous operation, does not require flow controls or systems and has practically no waste effluent.

The following nonlimiting examples illustrate the novel method of the present invention.

EXAMPLE I

A silver bromide electrode was prepared using a cell comprising a platinum cathode, a silver anode comprising a flat sheet of commercially obtained silver 1 in. ×

7 in. in size and, as an electrolyte, 600 ml. of 2% lithium bromide in water. A potential of 2 volts as measured at the power supply was applied to the system for one hour, resulting in a current flow of 0.4 amps. After 30 minutes, 12 g. of lithium bromide were added. At the end of the hour, the silver/silver bromide electrode formed from the silver anode was rinsed with water and immersed in a 1.5% potassium iodide solution until it took on about 3 mg. of iodide.

The thus-formed Ag/AgBrI electrode was then employed as a cathode with a cell comprising, in addition, a silver anode and, as an electrolyte, 250 ml. of 1% EDTA (2.3:1 disodium salt to free acid) and 2.5 g. of dry gelatin.

The cell comprised a 4 in. × 8 in. × 6 in. Plexiglas (trademark of Rohm and Haas Co., Philadelphia, Pa. for acrylic resin plastic sheet) tank. The anode was a flat sheet (1 in. × 7 in.) of silver obtained commercially and was positioned along one wall of the container. The cathode was positioned at the opposite wall of the tank, approximately 2 inches from the anode.

The cell was run for 2 hours at 2 volts (measured at the power supply) and 0.04 amps. At the end of that time, the grains were placed in a 250 ml. beaker and ammonium hydroxide solution was added until a pH of 7.8 was obtained. The mixture was heated at 50° C. and held at that temperature for one hour. The grains had grown to a mean diameter of about 0.8 μm. The solution pH was adjusted to 5.4 with sulfuric acid and the grains separated by centrifuging.

1 gram of the 0.8 μm grains were mixed with 1 gram of inert deionized gelatin, 6 ml. distilled water, 0.01 ml. of 0.1% hypo, 0.02 ml. gold as the thiocyanate complex (526 ppm gold) and digested for 60 minutes at 50° C. To the grains was added 1 ml. of a 2% solution of Triton X-100, (an octylphenoxy polyethoxy ethanol sold by Rohm & Haas Company, Philadelphia, Pennsylvania) and the mixture was coated on a plastic support at a coverage of about 100 mg./ft.2, exposed at equivalent ASA 18 and processed with a Type 42 receiving sheet and processing composition (Polaroid Corporation, Cambridge, Mass.). A continuous tone positive silver transfer image was obtained with a Dmin of 0 and a Dmax of 1.5. FIG. 1 is a photomicrograph of grains prepared according to the procedure of Example I. An analysis of the grains by X-ray fluorescence showed the grains to comprise silver iodobromide with about 2 mole percent iodide.

EXAMPLE II

Silver iodobromide grains were prepared according to the procedure of Example I up to the step of separation by centrifuging and were then grown according to the following procedure. To 100 ml. of the fine-grained silver iodobromide grains produced by the electrolysis was added 10 ml. of 20% freshly distilled 2,2'-thiodiethanol. The mixture was stirred for 15 minutes at 60° C. The remainder of the grains were added in 4 aliquots at 15 minutes intervals. The grain size ranged from 0.1 to 1.5 μm. The grains were separated by centrifuging.

2 grams of the thus-formed grains were mixed with 6 g. of inert deionized gelatin, 105 mls. of a 2% solution of the sodium salt of the dioctyl ester of sulfo-succinic acid, 0.01 ml. of 0.1% hypo, 0.2 ml. of gold as the thiocyanate complex (526 ppm gold) and digested for 210 minutes at 54° C. During this time the diffusion transfer speed (Type 42 processing) increased 3 stops. To the grains was then added 0.5 ml. of a 1 mg. per ml. of water of a cyanine sensitizing dye of the formula:

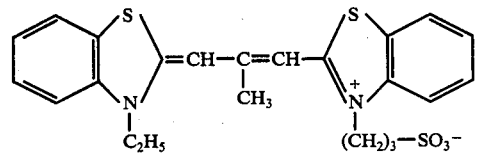

The mixture was coated on a plastic support at a silver coverage of about 100 mg./ft.2, exposed, and processed with a Polaroid Land Type 42 receiving sheet and processing composition. A continuous tone silver transfer image with panchromatic response was obtained.

Figure 2:
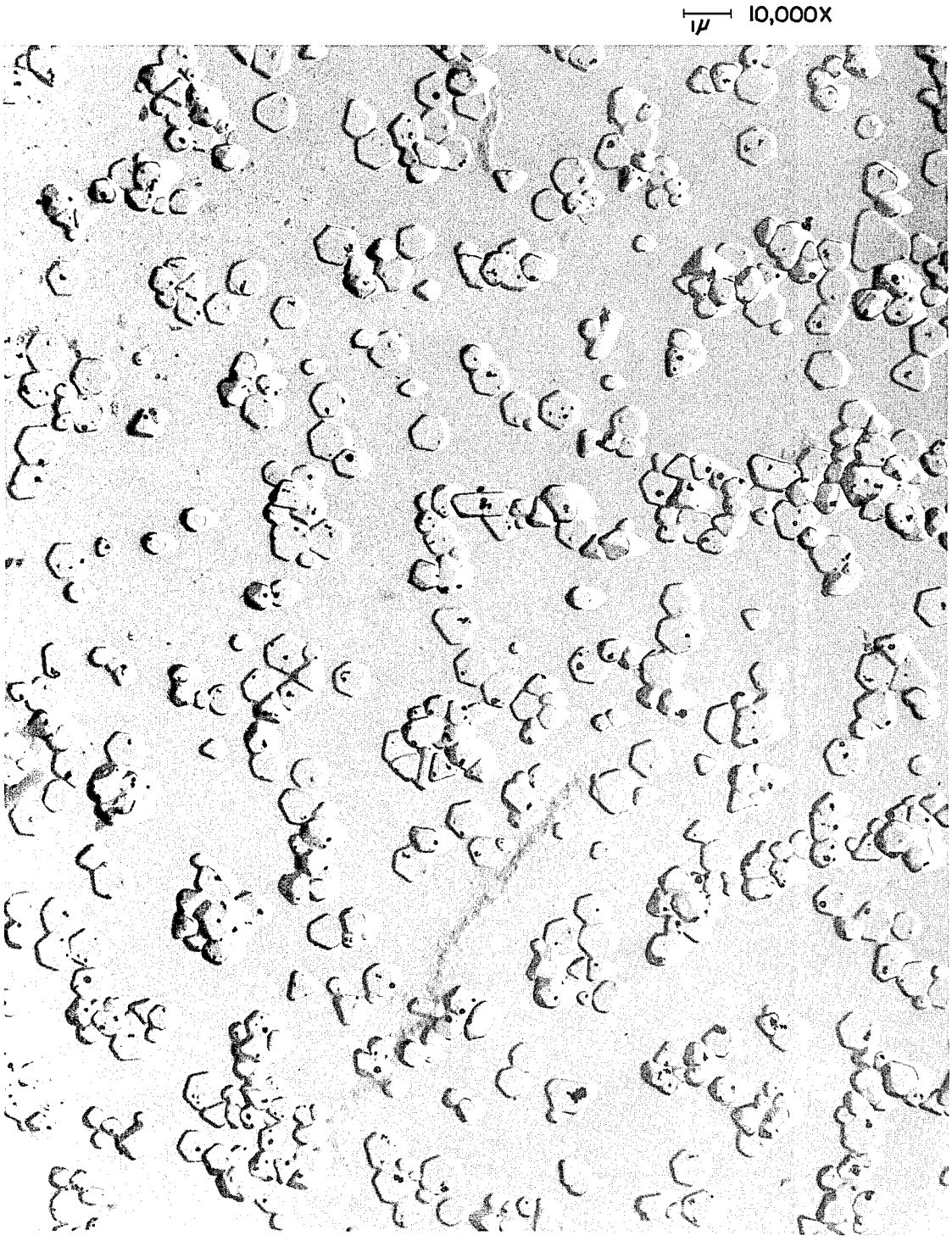
FIG. 2 is a photomicrograph at 10,000 magnification of silver iodobromide grains grown according to a procedure described in Example II of the present invention.

FIG. 2 is a photomicrograph of grains prepared according to the procedure of Example II.

EXAMPLE III

Figure 3:
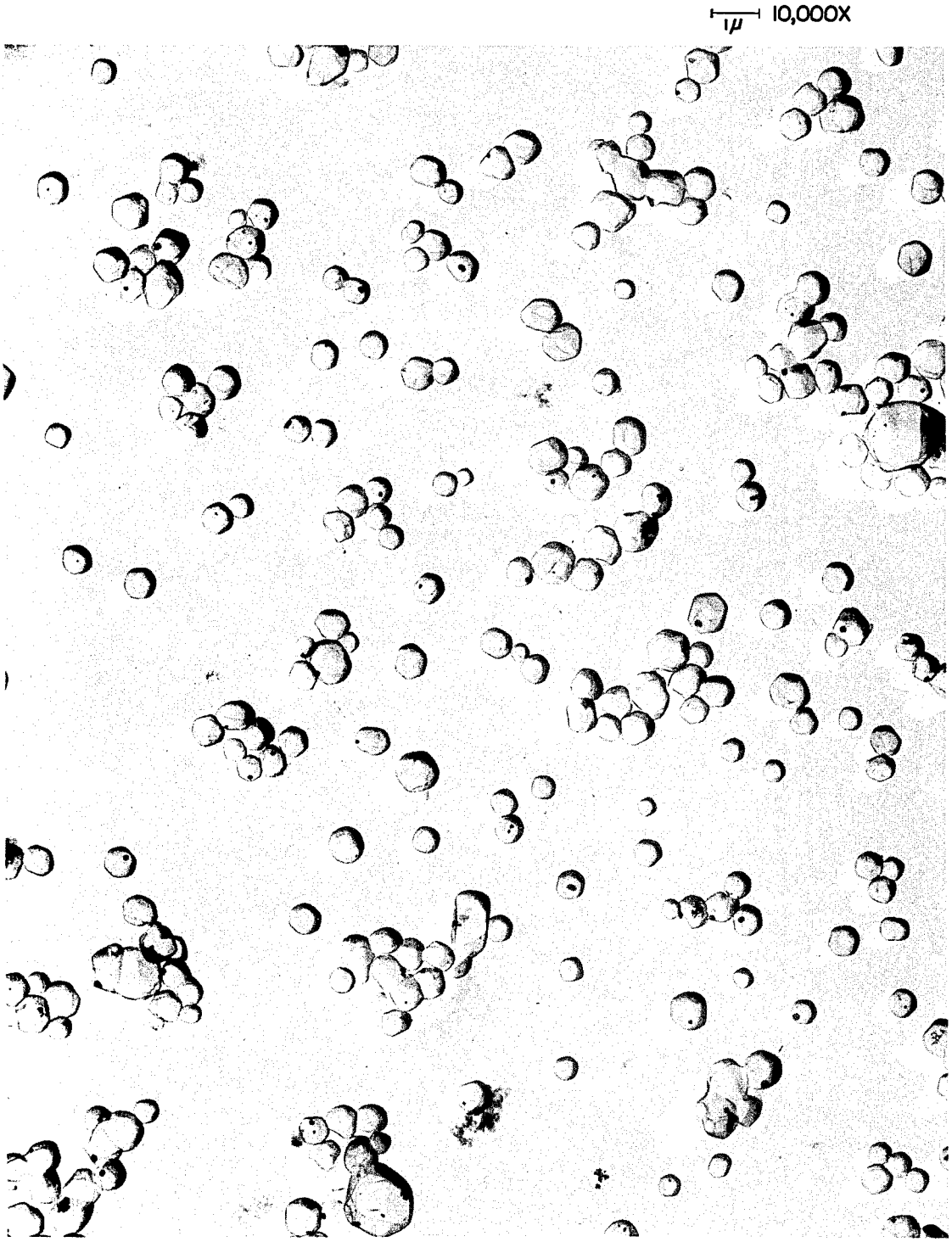
FIG. 3 is a photomicrograph at 10,000 magnification of silver bromide grains prepared according to Example III of the present invention.

A cell was constructed employing a 400 ml. beaker, a bromine cathode comprising a cellophane dialysis tube 1½ in diameter and 2 in. long enclosing 40 ml. of a 40% solution of an 80/20 2-acrylamido-2-methylpropane sulfonic acid/trimethylamine-N-acryloyl-methylalaninimide copolymer and 20 ml. of methanol, a platinum electrode (commercially available platinum basket) and 5 ml. of 20% bromine in methanol; as an anode, a silver sheet 2 in. × 8 in. wrapped around the inside wal of the beaker; and 250 ml. of a 5% solution of an 80/20 2-acrylamido-2-methylpropane sulfonic acid/-trimethylamine-N-acryloxyl-methylalaninimide copolymer. Additional bromine solution was added inside the tubing during electrolysis when the amperage dropped below 0.6. The cell was run for 5 hours at 2 volts (measured at the power supply) and at 0.6 amps. The thus-formed emulsion was then analyzed and was found to contain 5.2% silver. The silver bromide grains averaged about 0.5 μm in diameter. The grains were coated directly, without additional growing. FIG. 3 is a photomicrograph of grains prepared according to the procedure of Example III.

EXAMPLE IV

A silver iodobromide emulsion was prepared, coated and tested according to the procedure of Example II with the following changes: the electrolyte solution contained 1.25 g. of dry gelatin; the cell was run at 2 volts (measured at the power supply), 0.04 amps; ammonium hydroxide was added to a pH of 8.5 and the ammonium hydroxide-grain mixture was heated to 60° C and held at that temperature for one hour. The grains were found to have a mean diameter of about 0.7 μm with 90% of the grains having diameters within ± 25% of the mean diameter. The pH was adjusted to 5.5 with sulfuric acid and the pAg adjusted to 8.8.

Figure 4:
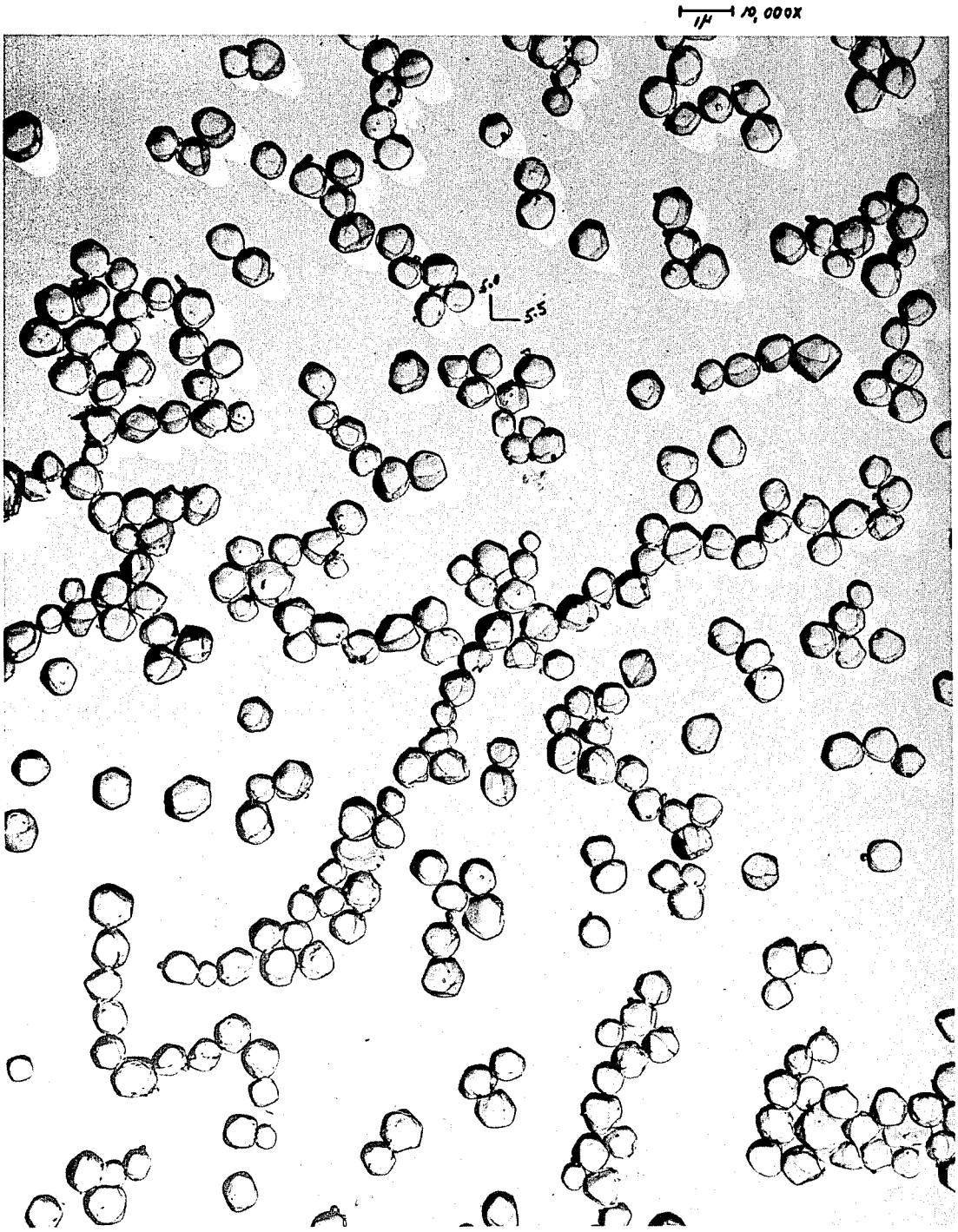
FIG. 4 is a photomicrograph at 10,000 magnification of silver iodobromide grains prepared according to the procedure of Example IV.

Following the coating, exposure and development procedure of Example I, a continuous tone positive silver transfer image was obtained. FIG. 4 is a photomicrograph of trains prepared by the procedure of Example IV.

With regard to the use of chemical sensitizing agents suitable for employment in the present invention, mention may be made of U.S. Pat. Nos. 1,574,944; 1,623,499; 2,410,689; 2,597,856; 2,597,915; 2,487,850; 2,518,698, 2,521,926; and the like, as well an Neblette, C. B., *Photography, Its Materials and Processes,* 6th Ed., 1962.

Spectral sensitization of the silver halide grains may be accomplished by contact of the grain composition with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes And Related Compounds,* as well as the above-mentioned disposition of the sensitizers in the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, also may be incorporated in the emulsion formuation, according to the conventional procedures known in the photographic emulsion manufacturing art.

While the use of emulsions of the present invention have been described primarily in terms of diffusion transfer processes, it should be understood that substantially any type of photographic process can be employed.

What is claimed is:

1. A method which comprises the electrolytic generation of silver ions and halide ions employing a silver anode and a cathode which is a source of halide ions and precipitation in the electrolyte of the ion pairs remove from the electrodes to provide photosensitive silver halide grains in the substantial absence of counterions in said electrolyte.

2. The method as defined in claim 1 wherein said silver ions and said halide ions are generated substantially simultaneously in a solution of an electrolyte.

3. The method as defined in claim 1 wherein said silver ions and said negative ions are generated substantially simultaneously in a solution of an electrolyte.

4. The method as defined in claim 1 wherein said ions are generated substantially stoichiometrically.

5. The method as defined in claim 1 wherein said ions are generated nonstoichiometrically.

6. The method as defined in claim 1 which includes the step of growing the thus-formed grains to a predetermined size.

7. The method as defined in claim 1 where said silver halide grains have a substantially uniform grain size distribution.

8. The method as defined in claim 1 wherein said halide ions comprise a plurality of halide ions.

9. The method as defined in claim 1 wherein said silver ions and said halide ions are generated by a plurality of electrodes.

10. The method as defined in claim 9 wherein a plurality of cathodes and/or anodes are employed sequentially in the generation of said ion pairs.

11. The method as defined in claim 2 which includes disposing the grains in a polymeric binder prior to coating the thus-formed mixture on a support.

12. The method as defined in claim 1 wherein said solution of an electrolyte includes a polymeric binder.

13. The method as defined in claim 12 wherein said polymeric binder is gelatin.

14. The method as defined in claim 12 wherein said polymeric binder comprises a conductive polymeric binder.

15. The method as defined in claim 14 wherein said polymeric binder is poly-2-acrylamido-2-methyl-propane sulfonic acid.

16. A method as defined in claim 12 wherein said polymeric binder is a copolymer of 2-acrylamido-2-methylpropane sulfonic acid and trimethylamine-N-acryloylmethylalaninimide.

17. The method as defined in claim 12 wherein said binder is present at a level of less than about 5%.

18. The method as defined in claim 3 wherein said ion pairs are generated from a silver anode and a halide salt cathode insoluble in said solution of an electrolyte.

19. The method as defined in claim 18 wherein said cathode is silver halide.

20. The method as defined in claim 19 wherein said cathode is silver bromide.

21. The method as defined n claim 19 wherein said cathode is silver iodobromide.

22. The method as defined in claim 1 wherein one of said electrodes comprises an elemental halogen.

23. The method as defined in claim 22 wherein said halogen is bromine.

24. The method as defined in claim 1 wherein said electrolyte comprises a sodium salt of ethylene diamine tetraacetic acid.

25. The method as defined in claim 1 which includes the step of Ostwald ripening said grains.

26. The method as defined in claim 3 wherein said solution of an electrolyte includes Ostwald ripening agents.

27. The method as defined in claim 3 wherein said solution of an electrolyte includes spectral sensitizing agents.

28. The method as defined in claim 3 wherein said solution of an electrolyte includes chemical sensitizing agents.

29. The method as defined in claim 25 which inclues the step of chemically sensitizing said grains subsequent to ripening.

30. The method as defined in claim 25 which includes the step of spectrally sensitizing said grains subsequent to ripening.

31. The method as defined in claim 25 which includes the step of Ostwald ripening said grains subsequent to gain formation.

32. The method as defined in claim 31 wherein said ripening step is carried out in the presence of ammonium hydroxide.

33. The method as defined in claim 31 wherein said ripening step is carried out in the presence of 2,2'-thiodiethanol.

34. A method for forming a photographic silver halide emulsion layer which comprises the steps of:

a. the substantially simultaneous generation of silver ions and halide ions in a solution of an electrolyte by electrolysis, employing a silver anode and a cathode which is a source of halide ions;
b. precipitating the ion pairs remote from said anode and cathode to provide silver halide grains in the substantial absence of counterions in said electrolyte;
c. growing said grains to a predetermined size;
d. photographically sensitizing said grains;
e. disposing said grains in a polymeric binder material; and
f. coating said binder and said grains on a support.

* * * * *

UNITED STATES PATENT AND TRADEMARK OFFICE

CERTIFICATE OF CORRECTION

PATENT NO. : 4,060,419

DATED : November 29, 1977

INVENTOR(S) : ARTHUR M. GERBER ET AL

It is certified that error appears in the above-identified patent and that said Letters Patent are hereby corrected as shown below:

In the Claims:

Column 7, line 33, "remove" should be --remote--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*